United States Patent [19]

Nemet-Mavrodin et al.

[11] Patent Number: 4,922,051

[45] Date of Patent: May 1, 1990

[54] PROCESS FOR THE CONVERSION OF $C_2$–$C_{12}$ PARAFFINIC HYDROCARBONS TO PETROCHEMICAL FEEDSTOCKS

[75] Inventors: Margaret Nemet-Mavrodin, Cherry Hill; Jorge L. Soto, Sewell, both of N.J.

[73] Assignee: Mobil Oil Corp., New York, N.Y.

[21] Appl. No.: 325,735

[22] Filed: Mar. 20, 1989

[51] Int. Cl.[5] ..... C07C 5/393; C07C 5/32

[52] U.S. Cl. ..... 585/418; 585/407; 585/430; 585/654; 585/661

[58] Field of Search ..... 585/407, 418, 430, 533, 585/627, 631, 520

[56] References Cited

U.S. PATENT DOCUMENTS

| | | | |
|---|---|---|---|
| 3,756,942 | 9/1973 | Cattanach | 208/137 |
| 3,926,781 | 12/1975 | Gale | 585/407 |
| 3,941,871 | 3/1976 | Dwyer et al. | 423/326 |
| 4,080,395 | 3/1978 | Butter | 585/407 |
| 4,341,748 | 7/1982 | Plank et al. | 423/328 |
| 4,517,402 | 5/1985 | Dessau | 258/310 Z |

OTHER PUBLICATIONS

"M2 Forming–A Process for Aromatization of Light Hydrocarbons," N. Y. Chen et al., 25 Ind. Eng. Chem. Process Des. Dev. 151, 1986.

"The Active Site of Acidic Aluminosilicate Catalysts"/309 *Nature,* 589–591 (1985) Haag et al.

*Primary Examiner*—Anthony McFarlane

*Attorney, Agent, or Firm*—Alexander J. McKillop; Charles J. Speciale; Robert B. Furr, Jr.

[57] ABSTRACT

A process is disclosed for the conversion of $C_2$–$C_{12}$ paraffinic hydrocarbons to more valuable petrochemical feedstocks including $C_2$–$C_4$ olefins and $C_6$–$C_8$ aromatics in the presence of a composite catalyst comprising a binder and at least one zeolite having a Constraint Index of between about 1 and 12, said composite catalyst having an alpha value of of greater than 5 and less than 33. It has been found that yields of valuable $C_2$–$C_4$ olefins and $C_6$–$C_8$ aromatics are increased by maintaining the composite catalyst alpha value within the claimed range.

19 Claims, No Drawings

PROCESS FOR THE CONVERSION OF $C_2$–$C_{12}$ PARAFFINIC HYDROCARBONS TO PETROCHEMICAL FEEDSTOCKS

BACKGROUND OF THE INVENTION

This invention relates to the co-production of aromatics, especially $C_6$–$C_8$ aromatics, and olefins, especially $C_2$–$C_4$ olefins, from paraffinic feedstocks (e.g. Udex raffinate) by converting these feedstocks in the presence of a medium-pore zeolite catalyst having closely controlled acid activity.

U.S. Pat. No. 3,756,942 to Cattanach, incorporated by reference as if set forth at length herein, discloses a process for converting paraffinic feedstocks over medium-pore zeolites to produce a variety of upgraded hydrocarbon products. The underlying chemistry involved in this conversion is extremely complex, including cracking of paraffins, aromatization of olefins, and alkylation and dealkylation of aromatics. The article "M2 Forming-A Process for Aromatization of Light Hydrocarbons", by N. Y. Chen and T. Y. Yan, 25 Ind. Eng. Chem. Process Des. Dev. 151, 1986 provides a general overview of the reactions and mechanisms believed to be involved in such aromatization reactions. Products from the conversion of $C_5$+paraffinic feedstocks over medium-pore zeolites such as ZSM-5 include $C_6$–$C_8$ aromatics, $C_2$–$C_4$ olefins, $C_9$+aromatics and $C_1$–$C_3$ paraffins. Of these products the $C_6$–$C_8$ aromatics and $C_2$–$C_4$ olefins are most desired.

$C_6$–$C_8$ aromatics, e.g. benzene, toluene, xylene and ethylbenzene, also known collectively as BTX, are valuable organic chemicals, useful both as intermediate feedstocks as well as saleable end products. Since BTX has a high octane value it can be used as a blending stock for making high octane gasoline. In contrast, $C_9$+aromatics (i.e. aromatic compounds having at least 9 carbon atoms) tend to have a relatively low octane value.

$C_2$–$C_4$ olefins, e.g. ethylene, propylene and butene, are also valuable organic chemicals which can be used to form polymers. By way of contrast, $C_1$–$C_3$ paraffins (i.e. methane, ethane and propane), particularly in admixture, are less valuable chemicals which are generally used for fuel.

From the foregoing, it can therefore well be seen that it would be highly desirable to shift selectivity in a process for upgrading paraffinic feedstreams toward more valuable products including $C_6$–$C_8$ aromatics and $C_2$–$C_4$ olefins.

The acid catalytic activity of zeolite catalysts, for example, aluminosilicate ZSM-5, is proportional to aluminum content in the framework of the zeolite. The more aluminum in the zeolite frmework, the greater the acid catalytic activity of the zeolite, particularly as measured by alpha value. Note the article by Haag et al., "The Active Site of Acidic Aluminosilicate Catalysts," 309 *Nature,* 589–591 (1985), especially FIG. 2 on page 590 thereof. Medium-pore zeolites with very little framework aluminum and correspondingly low acid catalytic activity can be prepared from reaction mixtures containing sources of silica and alumina, as well as various organic directing agents. For example, the Dwyer et al. U.S. Pat. No. 3,941,871, the entire disclosure of which is expressly incorporated herein by reference, describes the preparation of ZSM-5 from a reaction mixture comprising silica, tetrapropylammonium ions and no intentionally added alumina. The alumina to silica molar ratio of the ZSM-5 produced by this method may be less than 0.005.

U.S. Pat. No. 4,341,748, the entire disclosure of which is expressly incorporated herein by reference, describes the preparation of ZSM-5 from reaction mixtures which are free of organic directing agents. However, the reaction mixture for making this organic-free form of ZSM-5 is restricted to silica to alumina molar ratios of 100 or less. Consequently, this organic-free synthesis tends to produce ZSM-5 having a relatively high acid catalytic activity (e.g. alpha value) in comparison with zeolites prepared by the method of the Dwyer et al. U.S. Pat. No. 3,941,871.

Co-pending U.S. application 140,360, filed Jan. 4, 1988, cited above and incorporated by reference as if set forth at length herein, disclosed improvement in selectivity toward valuable $C_2$–$C_4$ olefins and $C_6$–$C_8$ aromatics by reducing the alpha value of the composite zeolite catalyst. However, until the advent of the present invention, the criticality of maintaining the composite catalyst alpha value within a narrow range has not been appreciated.

SUMMARY OF THE INVENTION

It has now been found in accordance with one aspect of the present invention that the selectivity of paraffinic feedstock conversion to $C_6$–$C_8$ aromatics and $C_2$–$C_4$ olefins in the presence of a medium-pore zeolite catalyst having a Constraint Index of between about 1 and about 12 is increased by controlling the acid activity of the zeolite within a narrow range of relatively low values.

According to one aspect of this application there is provided a process for converting a hydrocarbon feedstock comprising at least 75 percent by weight of a mixture of at least two paraffins having from 5 to 10 carbon atoms, said process comprising contacting said hydrocarbon feedstock under sufficient conditions with a catalyst comprising (1) a binder and (2) a zeolite having a Constraint Index of between about 1 and about 12, said zeolite being in particular an aluminosilicate zeolite, said composite catalyst having an alpha value of greater than 5 and less than 33, preferably about 10 to 20, whereby at least 90 percent by weight of said paraffins are converted to a product mixture.

DETAILED DESCRIPTION

Medium-Pore Zeolite Catalysts

The members of the class of zeolites useful in the process of the present invention have an effective pore size of generally from about 5 to about 8 Angstroms, such as to freely sorb normal hexane. In addition, the structure must provide constrained access to larger molecules. It is sometimes possible to judge from a known crystal structure whether such constrained access exists. For example, if the only pore windows in a crystal are formed by 8-membered rings of silicon and aluminum atoms, then access by molecules of larger cross section than normal hexane is excluded and the zeolite is not of the desired type. Windows of 10 -membered rings are preferred, although, in some instances, excessive puckering of the rings or pore blockage may render these zeolites ineffective.

Although 12-membered rings in theory would not offer sufficient constraint to produce advantageous conversions, it is noted that the puckered 12-ring structure of TMA offretite does show some constrained access. Other 12-ring structures may exist which may be operative for other reasons, and therefore, it is not the present invention to entirely judge the usefulness of the particular zeolite solely from theoretical structural considerations.

A convenient measure of the extent to which a zeolite provides control to molecules of varying sizes to its internal structure is the Constraint Index of the zeolite. The method by which the Constraint Index is determined is described in U.S. Pat. No. 4,016,218, incorporated herein by reference for details of the method. U.S. Pat. No. 4,696,732 discloses Constraint Index values for typical zeolite materials and is incorporated by reference as is set forth at length herein.

In a preferred embodiment, the catalyst is a zeolite having a Constraint Index of between about 1 and about 12. Examples of such zeolite catalysts include ZSM-5, ZSM-11, ZSM-12, ZSM-22, ZSM-23, ZSM-35and ZSM-48.

Zeolite ZSM-5 and the conventional preparation thereof are described in U.S. Pat. No. 3,702,886, the disclosure of which is incorporated herein by reference. Other preparations for ZSM-5 are described in U.S. Pat. Nos. Re. 29,948 (highly siliceous ZSM-5); 4,100,262 and 4,139,600, the disclosure of these is incorporated herein by reference. Zeolite ZSM-11 and the conventional preparation thereof are described in U.S. Pat. No. 3,709,979, the disclosure of which is incorporated herein by reference. Zeolite ZSM-12 and the conventional preparation thereof are described in U.S. Pat. No. 3,832,449, the disclosure of which is incorporated herein by reference. Zeolite ZSM-23 and the conventional preparation thereof are described in U.S. Pat. No. 4,076,842, the disclosure of which is incorporated herein by reference. Zeolite ZSM-35 and the conventional preparation thereof are described in U.S. Pat. No. 4,016,245, the disclosure of which is incorporated herein by reference. Another preparation of ZSM-35 is described in U.S. Pat. No. 4,107,195, the disclosure of which is incorporated herein by reference. ZSM-48 and the conventional preparation thereof is taught by U.S. Pat. No. 4,375,573, the disclosure of which is incorporated herein by reference.

Although the term "zeolites" encompasses materials containing silica and alumina, it is recognized that the silica and alumina portions may be replaced in whole or in part with other oxides. More particularly, $GeO_2$ is an art-recognized substitute for $SiO_2$. Also, $B_2O_3$, $Cr_2O_3$, $Fe_2O_3$, and $Ga_2O_3$ are art-recognized replacements for $Al_2O_3$. Accordingly, the term zeolite as used herein shall connote not only materials containing silicon and, optionally, aluminum atoms in the crystalline lattice structure thereof, but also materials which contain suitable replacement atoms for such silicon and/or aluminum. On the other hand, the term aluminosilicate zeolite as used herein shall define zeolite materials consisting essentially of silicon and aluminum atoms in the crystalline lattice structure thereof, as opposed to materials which contain substantial amounts of suitable replacement atoms for such silicon and/or aluminum.

Particularly preferred zeolites which can be used in accordance with the present process for converting paraffins include zeolites having the structure of ZSM-5 and ZSM-11. In addition to patents mentioned hereinabove, ZSM-5 is described in U.S. Pat. No. 3,702,886, the entire disclosure of which is expressly incorporated herein by reference. ZSM-11 is structurally similar to ZSM-5. In view of the structural similarities between ZSM-5 and ZSM-11, these two zeolites have been observed to have similar catalytic properties in the conversion of various hydrocarbons. ZSM-11 is described in U.S. Pat. No. 3,709,979, the entire disclosure of which is expressly incorporated herein by reference. It is to be understood that references in the following description to ZSM-5 or ZSM-11 are also applicable to the medium-pore zeolites in general, i.e. those zeolites having a Constraint Index of between about 1 and about 12.

Zeolites suitable for use in the present paraffin conversion process can be used either in the as-synthesized form, the alkali metal form and hydrogen form or another univalent or multivalent cationic form. These zeolites can also be used in intimate combination with a hydrogenating component such as tungsten, vanadium, molybdenum, rhenium, nickel, cobalt chromium, manganese, or a noble metal such as platinum or palladium where a hydrogenation-dehydrogenation function is to be performed. Such components can be exchanged into the composition, impregnated therein or physically intimately admixed therewith. Such components can be impregnated in or on to a zeolite such as, for example, by, in the case of platinum, treating the zeolite with a platinum metal-containing ion. Suitable platinum compounds for this purpose include chloroplatinic acid, platinous chloride and various compounds containing the platinum amine complex. Combinations of metals and methods for their introduction can also be used.

Although the zeolites suitable for use in the process of the present invention may optionally include various elements ion exchanged, impregnated or otherwise deposited thereon, it is preferred to use zeolites in the hydrogen form, wherein the pore space of these zeolites is free of intentionally added elements other than hydrocarbonaceous deposits, particularly those elements which are incorporated into the zeolite pore space by an ion exchange or impregnation treatment. Thus, these zeolites can be free of oxides incorporated into the zeolites by an impregnation treatment. Examples of such impregnated oxides include oxides of phosphorus as well as those oxides of the metals of Groups IA, IIA, IIIA, IVA, VA, VIA, VIIA, VIIIA, IB, IIB, IIIB, IVB, or VB of the Periodic Chart of the Elements (Fisher Scientific Company, Catalog No. 5-702-10). The impregnation of zeolites with such oxides is described in the Forbus et al. U.S. Pat. No. 4,55,394, the entire disclosure of which is expressly incorporated herein by reference, particularly the passage thereof extending from column 8, line 42 to column 9, line 68. The hydrogen form of zeolites may be prepared by calcining the as-synthesized form of the zeolites under conditions sufficient to remove water and residue of organic directing agents, if any, ion exchanging the calcined zeolites with ammonium ions and calcining the ammonium exchanged zeolites under conditions sufficient to evolve ammonia.

Medium-pore zeolite catalysts such as synthetic ZSM-5 or ZSM-11, when employed as part of a catalyst in a hydrocarbon conversion process, should be dehydrated at least partially. This can be done by heating to a sufficient temperature, e.g. in the range of from about 65° C. to about 550° C. in an inert atmosphere, such as air, nitrogen, etc., and at atmospheric or subatmospheric pressures for between 1 and 48 hours. Dehydration can be performed at lower temperature merely by placing the zeolite in a vacuum, but a longer time is required to obtain a particular degree of dehydration. Organic materials, e.g. residues of organic directing agents, can be thermally decomposed in the newly synthesized zeolites by heating same at a sufficient temperature below the temperature at which the significant decomposition of the zeolite framework takes place, e.g from about 200° C. to about 550° C., for a sufficient time, e.g. from 1 hour to about 48 hours.

Zeolites may be formed in a wide variety of particle sizes. Generally speaking, the particles can be in the form of a powder, a granule, or a molded product, such as extrudate having particle size sufficient to pass through a 2 mesh (Tyler) screen and be retained on a 400 mesh (Tyler) screen. In cases where the catalyst is molded, such as by extrusion, the crystalline material can be extruded before drying or dried or partially dried and then extruded.

In the case of the present catalysts, the zeolites are incorporated with another material resistant to the temperatures and other conditions employed in certain organic conversion processes. Such matrix or binder materials include active and inactive materials and synthetic or naturally occurring zeolites as well as incorganic materials such as clays, silica and/or metal oxides, e.g. alumina. The latter may be either naturally occurring or in the form of gelatinous precipitates, sols or gels including mixtures of silica and metal oxides. Use of a material in conjunction with a zeolite, i.e. combined therewith, which is active, may enhance the conversion and/or selectivity of the catalyst in certain organic conversion processes. Inactive materials suitably serve as diluents to control the amount of conversion in a given process so that products can be obtained economically and orderly without employing other means for controlling the rate of reaction. Frequently, crystalline silicate materials have been incorporated into naturally occurring clays, e.g. bentonite and kaolin. These materials, i.e. clays, oxides, etc., function, in part, as binders for the catalyst. It is desirable to provide a catalyst having good crush strength because the catalyst may be subjected to rough handling which tends to break the catalyst down into powder-like materials which cause problems in processing.

Naturally occurring clays which can be composited with zeolites include the montmorillonite and kaolin families which include the subbentonites, and the kaolins commonly known as Dixie, McNamee, Georgia and Florida clays, or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, zeolites can be composited with a porous matrix material such as silica-alumina, silica-magnesia, silica-zirconia, silica-thoria, silica-beryllia, silica-titania, as well as ternary compositions such as silica-alumina-thoria, silica-alumina-zirconia, silica-alumina-magnesia and silica-magnesia-zirconia. The matrix can be in the form of a cogel. A mixture of these components could also be used.

The catalyst used in the present paraffin conversion process may be in a variety of forms including in the form of extrudates or spray-dried microspheres. The Bowes U.S. Pat. No. 4,582,815, the entire disclosure of which is expressly incorporated herein by reference, describes a silica and ZSM-5 extrudate. The Chu et al. U.S. Pat. No. 4,522,705 describes spray-dried microspheres containing alumina and ZSM-5. This form of microspheres, as opposed to extrudates, is preferred when the catalyst is to be contacted with the hydrocarbon feedstock in a fluid bed reactor.

Conversion Process

Hydrocarbon feedstocks which can be converted according to the present process include various refinery streams including coker gasoline, light F.C.C. gasoline, as well as $C_5$ to $C_7$ fractions of straight run naphthas and pyrolysis gasoline. Particular hydrocarbon feedstocks are raffinates from a hydrocarbon mixture which has had aromatics removed by a solvent extraction treatment. Examples of such solvent extraction treatments are described on pages 706–709 of the *Kirk-Othmer Encyclopedia of Chemical Technology*, Third Edition, Vol. 9, 706–709 (1980). A particular hydrocarbon feedstock derived from such a solvent extraction treatment is a Udex raffinate. The paraffinic hydrocarbon feedstock suitable for use in the present process may comprise at least 75 percent by weight, e.g. at least 85 percent by weight, of paraffins having from 2 to 12, preferably from 5 to 10 carbon atoms.

The paraffinic hydrocarbons may be converted under sufficient conditions including, e.g. a temperature of from about 100° C. to about 700° C., a pressure of from about 0.1 atmosphere to about 60 atmospheres, a weight-hourly space velocity of from about 0.5 to about 400 and a hydrogen/hydrocarbon mole ratio of from about 0 to about 20. Suitable reaction conditions are also described in the aforementioned Cattanach U.S. Pat. No. 3,756,942.

The catalyst used in the present paraffin conversion process may have a relatively low acid catalytic activity for a medium-pore zeolite catalyst. More particularly, these catalysts may have an alpha value of from 2 to 12, preferably from 5 to 10. When alpha value is referred to herein, it is noted that the alpha value is an approximate indication of the catalytic cracking activity of the catalyst compared to a standard catalyst and it gives the relative rate constant (rate of normal hexane conversion per volume of catalyst per unit time). It is based on the activity of the highly active silica-alumina cracking catalyst taken as an alpha of 1 (Rate Constant=0.016 $sec^{-1}$). Alpha tests are described in U.S. Pat. No. 3,354,078 and in *The Journal of Catalysis, IV*, 522–529 (1965), each incorporated herein by reference as to that description. Alpha tests are also described in *J. Catalysis*, 6, 278 (1966) and *J. Catalysis*, 61, 395 (1980), each also incorporated herein by reference as to that description, with experimental conditions of the test used herein including a constant temperature of 538° C. and a variable flow rate as described in *J. Catalysis* 61, 395.

In accordance with the present process, the present hydrocarbon feedstock is converted under sufficient conditions to convert at least 90 percent by weight (e.g. at least 93 percent by weight) of the paraffins present into different hydrocarbons. These different hydrocarbons may comprise at least 90 percent by weight (e.g. at least 95 percent by weight) of the sum of $C_6$–$C_8$ aromatics, $C_2$–$C_4$ olefins, $C_9$+aromatics and $C_1$–$C_3$ paraffins. The conversion of paraffins may be less than 100 percent, e.g. 99 percent by weight or less. Conversion of paraffins under excessively extreme conditions may cause excessive coke formation on the catalyst and may result in the further conversion of $C_2$–$C_4$ olefins and $C_6$–$C_8$ aromatics into less desired products. The conversion products may include at least 68 percent by weight of the sum of $C_6$–$C_8$ aromatics plus $C_2$–$C_4$ olefins.

The catalyst suitable for use in accordance with the present invention may have an alpha value of of greater than 5 and less than 33, preferably about 10 to 20. This narrow range of alpha values may be achieved in a variety of ways. For example, the active zeolite portion of the catalyst could be blended with sufficient amounts of inert binder material. Thus, the ratio of binder to zeolite may be at least 70:30, preferably at least 95:5. Another way of achieving an alpha value within the desired range is to subject a more active catalyst, e.g. having an alpha value of at least 50 in the catalytically activated form, to sufficient deactivating conditions. Examples of such deactivating conditions include steaming the catalyst, coking the catalyst and high temperature calcination of the catalyst, e.g. at a temperature of greater than 700° C. It may also be possible to partially deactivate the catalyst by subjecting the catalyst to a sufficient amount of a suitable catalyst poison. Catalysts which have been deactivated in the course of organic compound conversions, particularly where the catalyst has been subjected to conditions of high temperature, coking and/or steaming, may be useful. Examples of such organic compound conversions include the present conversion of $C_2$–$C_{12}$ paraffins and the conversion of methanol into hydrocarbons.

It may also be possible to use zeolites which are intrinsically less active by virtue of having a high silica to alumina molar ratio of, e.g. greater than 100. However, since ZSM-5 may be more difficult to prepare at such higher silica to alumina ratios, particularly in the absence of an organic directing agent, it may be more desirable to use a more active form of ZSM-5, e.g. having a silica to alumina molar ratio of 100 or less. Even though the alpha value of the activated form of such ZSM-5 may be rather high, the alpha value of the bound catalyst may be made much lower by one or more of the above-mentioned techniques. For example, ZSM-5 prepared from a reaction mixture not having an organic directing agent and having a framework silica to alumina molar ratio of about 70:1 or less may be bound with an inert binder at a binder:ZSM-5 weight ratio of 75:25, and the bound catalyst could be subjected to sufficient deactivating conditions involving high temperature calcination and/or steaming of the catalyst.

The catalyst suitable for use in accordance with the present invention may be free of intentionally added gallium. More particularly, the only gallium in the catalyst may result from unavoidable trace gallium impurities either in the binder or in the sources of silica and alumina used to prepare the zeolite.

The paraffin conversion process of the present invention may take place either in a fixed bed or a fluid bed of catalyst particles. Particularly, when a fluid bed process is used, the process parameters may be adjusted to cause partial deactivation of the catalyst, thereby enabling the increase in selectivity to $C_6$–$C_8$ aromatics and $C_2$–$C_4$ olefins. In such a fluid bed process, the paraffinic feedstock is contacted with a fluid bed of catalyst, whereby conversion products are generated. Lighter hydrocarbons can be separated from the catalyst by conventional techniques such as cyclone separation and, possibly, steam stripping. However, the dense hydrocarbonaceous deposit (e.g. coke) which forms on the catalyst is more difficult to remove. This hydrocarbonaceous deposit may be removed by transporting the catalyst to a separate regenerator reactor, wherein the hydrocarbonaceous deposit is burned off the catalyst. The regenerated catalyst may then be returned to the fluid bed reactor for further contact with the paraffinic feedstock.

It is quite apparent from this process that the catalyst is constantly subjected to conditions which tend to deactivate the catalyst. These conditions include steaming, high temperatures and coking. Normally, the operator of such a process would tend to minimize the rate of catalyst deactivation by controlling parameters such as the amount and temperature of steam in the strpping section, the residence time of the catalyst in the various stages, the rate of catalyst recycle and the temperature in the regenerator. Some deactivation of the catalyst is inevitable, but the activity of the overall catalyst inventory may be maintained near its original level by periodically removing aged catalyst from the system and by replacing this aged catalyst with fresh catalyst. However, in view of the present discovery of improved product selectivity as a result of using catalyst having a controlled, relatively low acid activity value, the process operator may now be motivated to use the process parameters at his disposal to optimize catalyst aging while at the same time refraining from replacing aged catalyst with fresh catalyst at a rapid rate. In such a process, the operator could monitor the rate of catalyst deactivation by reducing the weight hourly space velocity (WHSV) of the feed, while maintaining a constant rate of conversion under otherwise constant conditions. As activity of the catalyst decreases the operator would also observe an improved selectivity to $C_6$–$C_8$ aromatics and $C_2$–$C_4$ olefins.

EXAMPLES

A mixture of $C_5$–$C_{10}$ aliphatic hydrocarbons rejected from the Udex extraction of refinery light reformate (Udex raffinate) was converted over a fluid bed catalyst incorporating 25 wt.% of a ZSM-5 zeolite. The catalyst composites had alpha activities, measured by the standard n-hexane cracking test shown below. The conversion reaction was carried out at approximately 1150° F., 0.5 WHSV raffinate (based on total catalyst weight) and atmospheric pressure.

TABLE 1

| UDEX Raffinate Composition | |
|---|---|
| Component | Wt. % |
| $C_4$ paraffins | 0.09 |
| $C_5$ paraffins | 3.87 |
| $C_5$ olefins and naphthenes | 0.87 |
| $C_6$ paraffins | 51.44 |
| $C_6$ olefins and naphthenes | 3.06 |
| $C_7$ paraffins | 32.33 |
| $C_7$ olefins and naphthenes | 0.31 |
| $C_8$ + PON | 3.80 |
| Benzene | 0.16 |
| Toluene | 3.98 |
| Xylenes | 0.09 |
| Other Properties: | |
| Specific gravity: | 0.674 |
| Clear (R + O) octane number: | 66.5 |

| | Example 1 | Example 2 | Example 3 |
|---|---|---|---|
| Catalyst Alpha Activity | 5 | 9 | 33 |
| TOS, days | 0.4 | 0.3 | 0.4 |

-continued

| | Example 1 | | Example 2 | | Example 3 | |
|---|---|---|---|---|---|---|
| PON Conv., % | 91.3 | | 92 | | 90.2 | |
| Net Yields From Feed PON, Wt. % | | | | | | |
| $H_2$ | 1.2 | | 1.4 | | 1.8 | |
| $CH_4$ | 18.3 | | 14.9 | | 15.0 | |
| $C_2H_4$ | 12.1 | | 17.1 | | 15.2 | |
| $C_2H_6$ | 13.0 | | 7.5 | | 10.1 | |
| $C_3H_8$ | 4.9 | | 3.5 | | 4.9 | |
| $C_3H_6$ | 14.7 | | 18.0 | | 13.4 | |
| $C_4H_8$ | 6.1 | | 6.2 | | 4.3 | |
| Benzene | 9.2 | | 10.3 | | 12.2 | |
| Toluene | 6.8 | | 7.2 | | 8.2 | |
| $C_8$ Aromatics | 2.1 | | 2.5 | | 3.9 | |
| $C_2$–$C_4$ Olefins | 32.9 | 51.0 | 41.3 | 61.3 | 32.9 | 57.4 |
| $C_6$–$C_8$ Aromatics | 18.1 | | 20.0 | | 24.5 | |

Changes and modifications in the specifically described embodiments can be carried out without departing from the scope of the invention which is intended to be limited only by the scope of the appended claims.

What is claimed is:

1. A process for converting a hydrocarbon feedstock comprising at least 75 percent by weight of a mixture of at least two different paraffins having from 2 to 12 carbon atoms comprising the steps of contacting said hydrocarbon feedstock under conversion conditions with a composite catalyst comprising (1) a binder and (2) a zeolite having a Constraint Index of between about 1 and about 12, said zeolite being an aluminosilicate, said composite catalyst having an alpha value of greater than 5 and less than 33, whereby at least 90 percent by weight of said paraffins are converted to a hydrocarbon product mixture.

2. The process of claim 1 wherein said zeolite has the structure of at least one selected from the group consisting of ZSM-5, ZSM-11, ZSM-12, ZSM-23, ZSM-35 and ZSM-48.

3. The process of claim 2 wherein said zeolite has the structure of ZSM-5.

4. The process of claim 1, wherein the activated form of the fresh catalyst as initially prepared has an alpha value of at least 50 and the fresh catalyst is partially deactivated by subjecting the fresh catalyst to sufficient deactivating conditions to achieve an alpha value of greater than 5 and less than 33 for said catalyst.

5. The process of claim 1, wherein the fresh catalyst is partially deactivated by a treatment selected from he group consisting of steaming the catalyst, coking the catalyst, calcining the catalyst at a temperature of greater than 700° C., and combinations of said steaming, coking and calcining.

6. The process of claim 1, wherein said catalyst is free of intentionally added gallium.

7. The process of claim 1, wherein said catalyst is prepared by combining a binder material with an aluminosilicate, said binder consisting essentially of alumina or silica in combination with alumina, said aluminosilicate zeolite having a silica to alumina ratio of less than 100.

8. The process of claim 7, wherein said zeolite is prepared from an aqueous reaction mixture comprising sources of silica and alumina, said reaction mixture being free of an organic directing agent.

9. The process of claim 1, wherein said composite catalyst has an alpha value of between about 10 and about 20.

10. The process of claim 8, wherein the weight ratio of binder to zeolite is at least 95:5.

11. The process of claim 1, wherein said hydrocarbon feedstock is a raffinate from a solvent extraction treatment which removes aromatics from a hydrocarbon feedstream.

12. The process of claim 11, wherein said hydrocarbon feedstock is a Udex raffinate.

13. The process of claim 1, wherein said hydrocarbon feedstock is contacted with said composite catalyst in a fluid bed reactor.

14. The process of claim 1, wherein the reaction conditions include a temperature of from about 400° C. to about 700° C., a pressure of from about 0.1 atmosphere to about 60 atmospheres, a weight hourly space velocity of from about 0.1 to about 400 and a hydrogen/hydrocarbon mole ratio of from about 0 to about 20.

15. The process of claim 1, wherein less than 100 percent of said paraffins are converted.

16. The process of claim 1, wherein said zeolite has the structure of ZSM-5.

17. The process of claim 1, wherein said hydrocarbon product mixture comprises at least 55 percent by weight of the sum of $C_6$–$C_8$ aromatics and $C_2$–$C_4$ olefins.

18. The process of claim 1, wherein said zeolite is in the hydrogen form and said zeolite is free of metal oxides impregnated thereon.

19. A process for converting a hydrocarbon feedstock comprising at least 75 percent by weight of a mixture of at least two different paraffins having from 2 to 12 carbons atoms, said process comprising the steps of:

(i) contacting said hydrocarbon feedstock under sufficient conditions with a fluid bed of composite catalyst comprising (1) a binder and (2) at least one zeolite having a Constraint Index of between 1 and 12, wherein said composite catalyst has an initial alpha value of at least about 50 prior to contact with said feedstock, whereby at least 90 percent by weight of said paraffins are converted to a product mixture, and whereby a hydrocarbonaceous deposit is formed on said catlayst;

(ii) separating said composite catalyst of step (i) from hydrocarbons and recovering $C_6$–$C_8$ aromatics and $C_2$–$C_4$ olefins from said product mixture;

(iii) removing said hydrocarbonaceous deposit from separated composite catalyst of step (ii) by contacting said separated catalyst with a gas comprising oxygen under conditions sufficient to oxidize said hydrocarbonaceous deposit; and (iv) recycling catalyst from step (iii) to said fluid bed of step (i), said process further comprising the steps of:

(v) adjusting the process parameters to cause partial deactivation of the catalyst introducted into the fluid bed of step (i) to achieve an average alpha activity of composite catalyst in said fluid bed greater than 5 and less than 33; and (vi) continuing the process, whereby the selectivity to the sum of $C_6$–$C_8$ aromatics and $C_2$–$C_4$ olefins is increased.

* * * * *